US006505682B2

(12) United States Patent
Brockman

(10) Patent No.: US 6,505,682 B2
(45) Date of Patent: Jan. 14, 2003

(54) CONTROLLING PRODUCTION

(75) Inventor: Mark W. Brockman, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 09/493,318

(22) Filed: Jan. 28, 2000

(65) Prior Publication Data

US 2002/0066561 A1 Jun. 6, 2002

Related U.S. Application Data

(60) Provisional application No. 60/117,684, filed on Jan. 29, 1999.

(51) Int. Cl.[7] ..... E21B 43/12

(52) U.S. Cl. ..... 166/250.15; 166/53; 166/386; 166/66; 166/369

(58) Field of Search ..... 166/53, 66.6, 66.7, 166/373, 386, 319, 250.15, 369

(56) References Cited

U.S. PATENT DOCUMENTS

| | | | | |
|---|---|---|---|---|
| 3,739,845 A | | 6/1973 | Berry et al. | |
| 3,951,338 A | | 4/1976 | Genna | |
| 4,936,386 A | | 6/1990 | Colangelo | |
| 5,609,204 A | | 3/1997 | Rebardi et al. | |
| 5,662,165 A | | 9/1997 | Tubel et al. | |
| 6,119,780 A | * | 9/2000 | Christmas | 166/313 |
| 6,138,754 A | * | 10/2000 | Veneruso et al. | 166/250.03 |
| 6,176,312 B1 | * | 1/2001 | Tubel et al. | 166/250.15 |

* cited by examiner

*Primary Examiner*—Hoang Dang
(74) *Attorney, Agent, or Firm*—Trop, Pruner & Hu, P.C.; Jeffrey E. Griffin; Brigitte L. Jeffery

(57) ABSTRACT

A tubing is used in a well bore capable of furnishing a well fluid. The tubing has an annular member having a passageway. The tubing has at least one port that is connected to detect a composition of the well fluid and control flow of the well fluid into the passageway based on the composition.

10 Claims, 13 Drawing Sheets

CONTROLLING PRODUCTION

This application claims priority under 35 U.S.C. §119 to U.S. Provisional Application Serial No. 60/117,684, entitled "CONTROLLING PRODUCTION," filed Jan. 29, 1999.

BACKGROUND

The invention relates to controlling production.

As shown in FIG. 1, a subterranean well might have a lateral wellbore that is lined by a monobore casing 12. Besides supporting the lateral wellbore, the monobore casing 12 serves as a conduit to carry well fluids out of the lateral wellbore. The lateral wellbore extends through several regions called production zones where a producing formation has been pierced by explosive charges to form fractures 14 in the formation. Near the fractures 14, the monobore casing 12 has perforations 16 which allow well fluid from the formation to flow into a central passageway of the monobore casing 12. The well fluid flows though the monobore casing 12 into a production tubing 11 which carries the well fluid to the surface of the well. The well fluid typically contains a mixture of fluids, such as water, gas, and oil.

To aid the well fluid in reaching the surface, a pump 10 is typically located in the production tubing 11 near the union of the production tubing 11 and the casing 12. The pump 10 typically receives power through power cables 2 which extend downhole to the pump 10 from the surface. Annular packers 2 are typically used to form a seal between the pump 10 and the interior of the production tubing 11.

SUMMARY

The invention provides a tubing that has radial ports for controlling the flow of well fluid into a passageway of the tubing. Each port detects a composition of the well fluid and based on the detected composition, the port controls the flow of the well fluid into the passageway. As a result, production zones of a wellbore may be isolated, and the failure of one production zone does not require a complete shut-down of the wellbore.

In one embodiment, the invention features a tubing for use in a well bore capable of furnishing a well fluid. The tubing has an annular member having a passageway. The tubing has at least one port that is connected to detect a composition of the well fluid and control flow of the well fluid into the passageway based on the composition.

In another embodiment, the invention features a method for use in a well bore capable of furnishing a well fluid. The method includes detecting a composition of the well fluid. The flow of the well fluid into a passageway of a tubing is automatically controlled based on the composition.

Other advantages and features will become apparent from the description and from the claims.

DETAILED DESCRIPTION

Figure 1:
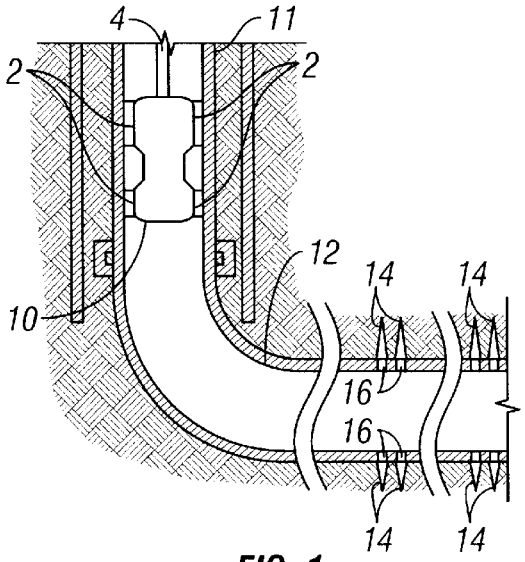
FIG. 1 (Prior Art)
FIG. 1 is a schematic view of a well bore of the prior art.
Figure 2:
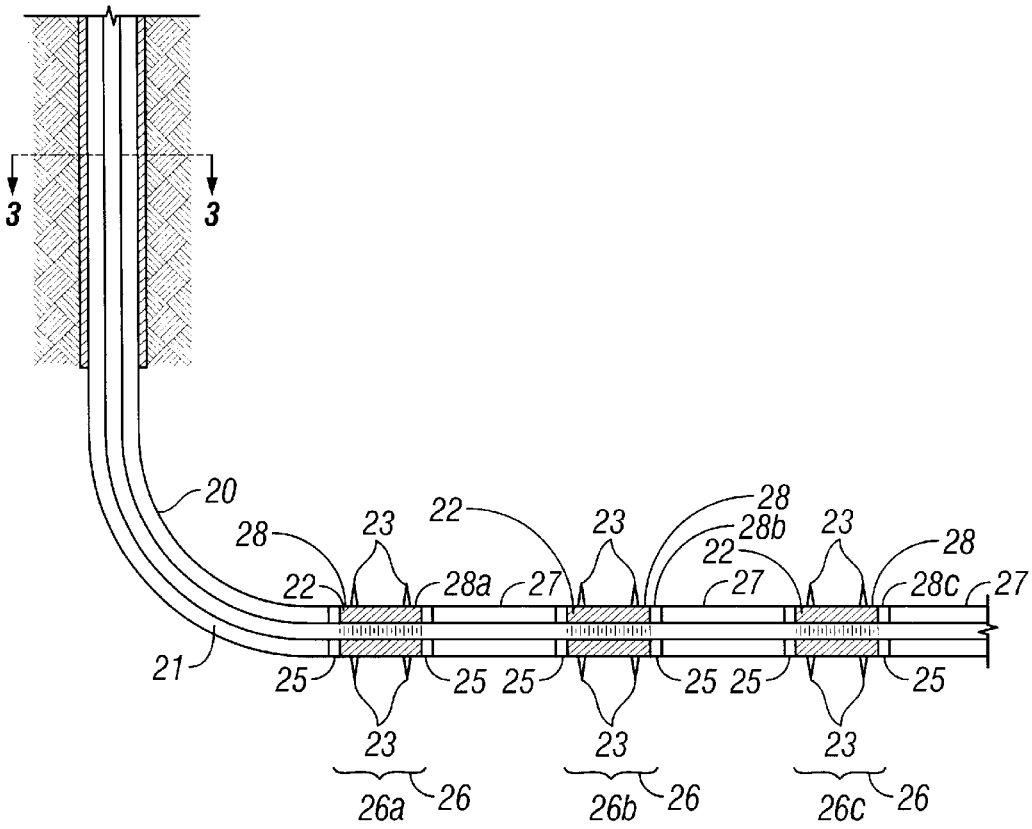
FIG. 2 is a schematic view illustrating a lateral well bore according to one embodiment of the invention.
Figure 3:
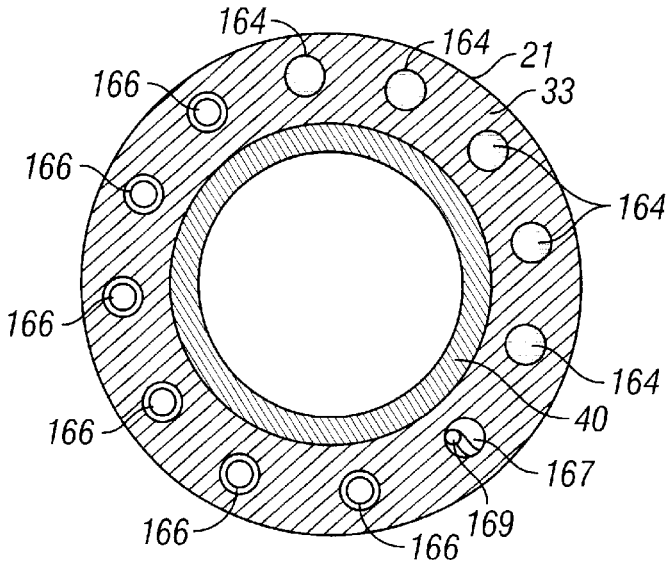
FIG. 3 is a cross-sectional view taken along line 3—3 of FIG. 2.

As shown in FIGS. 2 and 3, a communication infrastructure is embedded in a well casing 21 of a subterranean well. The infrastructure has fluid 166, electrical 164 and conduit 167 lines that may be used for such purposes as distributing energy to downhole tools, actuating downhole tools, receiving energy from downhole power sources, transferring fluid (e.g., chemicals) downhole, and providing data communication with downhole tools. By embedding the communication infrastructure within the casing 21, the infrastructure is protected from being damaged by contact with other objects (e.g., a production tubing or sucker rods used to actuate a downhole pump) inside of a central passageway of the casing 21.

The lines 164–167 of the infrastructure extend along a longitudinal length of the casing 21 and are substantially aligned with a central axis of the casing 21. The lines 164–167 may follow curved paths as the lines 164–167 extend downhole. For example, the fluid lines 166 may follow helical paths around the casing 21 to impart rigidity and provide structural support to the casing 21. The electrical lines 164 may be optimally positioned to minimize inductive coupling between the lines 164. For example, if three of the lines 164 carry three phase power, each of the three lines 164 might be placed in a comer of a triangular cylinder to minimize the electromagnetic radiation from the three lines 164. Electromagnetic radiation may also be reduced by twisting selected lines 164 together to form "twisted pairs."

The inner core of the casing 21 is formed from a tubing 40. The tubing 40 and communication infrastructure (selectively placed around an outer surface of the tubing 40) are encased by an encapsulant 33 which is bonded (and sealed) to the outer surface of the tubing 40. The encapsulant 33 may be formed from such materials as a plastic or a soft metal (e.g., lead). The encapsulant 33 may also be a composite material. The tubing 40 is formed out of a material (e.g., metal or a composite) that is flexible but capable of structurally supporting of the well bore.

Figure 5:
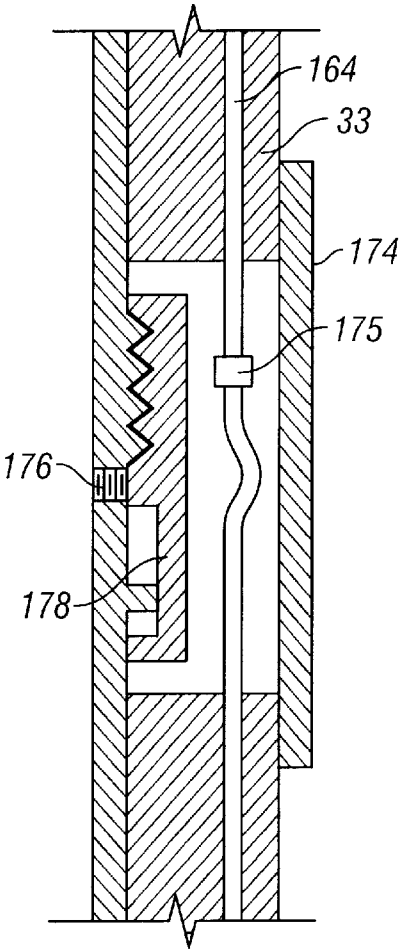
FIG. 5 is a detailed schematic view illustrating the union of two adjacent sections of the well casing.
Figure 5:
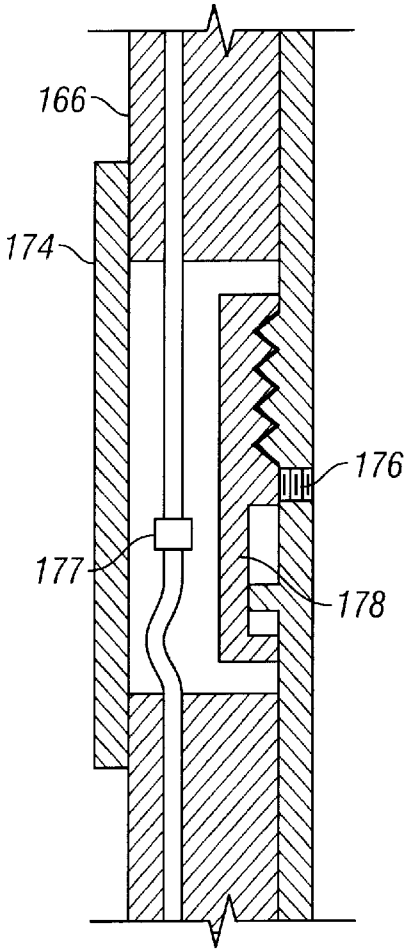
Figure 4:
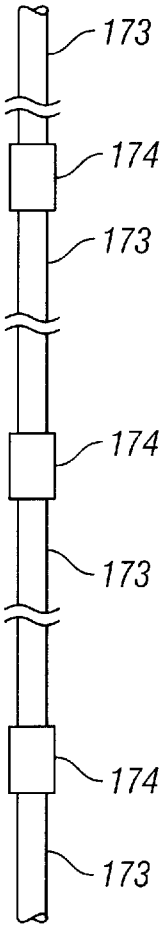
FIG. 4 is a schematic view illustrating the sections of the well casing.

As shown in FIG. 4, in some embodiments, at least a portion of the tubing may be formed out of one or more joined modular sections 173. Adjoining sections 173 may be connected by a variety of different couplers, like the one shown in FIG. 5. At the union of adjoining sections 173, an annular gasket 176 placed at the end of the sections 173 seals the tubings 40 of both sections 173 together. To secure the adjoining tubings 40 together, a threaded collar 178 mounted near the end of one tubing 40 is adapted to mate with threads formed near the end of the adjoining tubing 40. The threaded collar 178 is slidably coupled to the tubing 40 and adapted to protect and radially support the gasket 176 once the adjoining tubings 40 are secured together.

After the tubing 40 of adjoining sections 173 are attached to one another, the communication infrastructures of the adjoining sections 173 are coupled together (e.g., via connectors 175 and 177). Once the connections between the tubings 40 and communication infrastructures of adjoining sections 173 are made, a slidably mounted, protective sleeve 174 (located on the outside of the casing 21) is slid over the connections and secured to the encapsulant 33.

The modular sections 173 may be connected in many different arrangements and may be used to perform many different functions. For example, the modular sections 173 may be connected together to form a section of a production string. The sections 173 may be detachably connected together (as described above), or alternatively, the sections 173 may be permanently connected (welded, for example) together. The sections 173 may or may not perform the same functions. For example, some of the sections 173 may be used to monitor production, and some of the sections 173 may be used to control production. The sections 173 may be located in a production zone or at the edge of a production zone, as examples. In some embodiments, a particular section 173 may be left free-standing at the end of the tubing, i.e., one end of the section 173 may be coupled to the remaining part of the tubing, and the other end of the section 173 may form the end of the tubing. As another example, the section(s) 173 may be used for purposes of completing a well. Other arrangements and other ways of using the sections 173 are possible.

Figure 6:
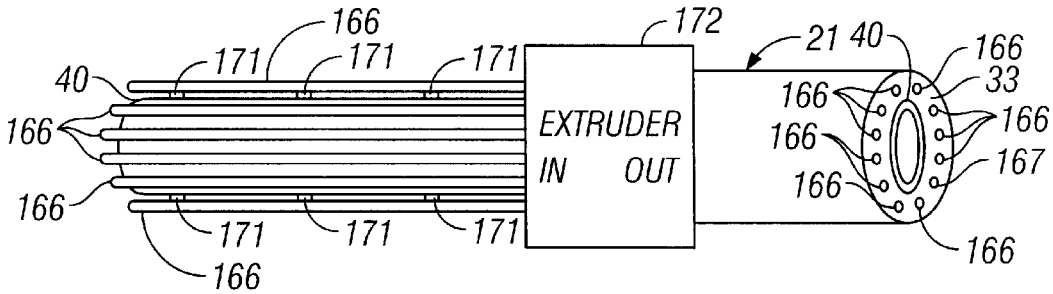
FIG. 6 is a schematic view illustrating one way to encapsulate a tubing of the casing.

A number of techniques may be used to form the encapsulant 33 on the tubing 40, such as an extruder 172 (FIG. 6). The extruder 172 has a die (not shown) with openings for the lines 164–167 and the tubing 40. Spacers 171 radially extend from the tubing 40 to hold the lines 164–167 in place until the encapsulant 33 hardens.

Figure 8:
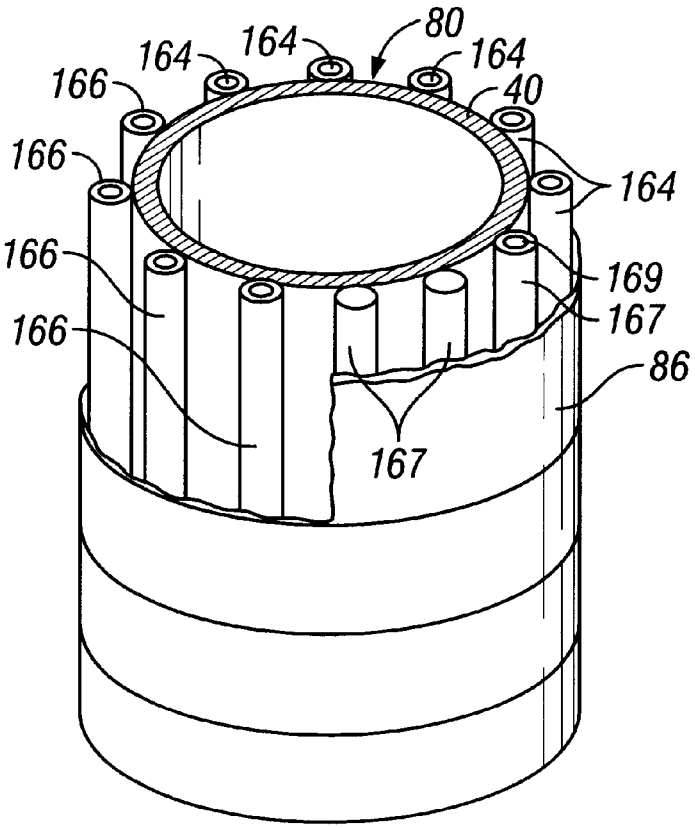
FIGS. 7 and 8 are perspective view of alternative types of well casings.
Figure 7:
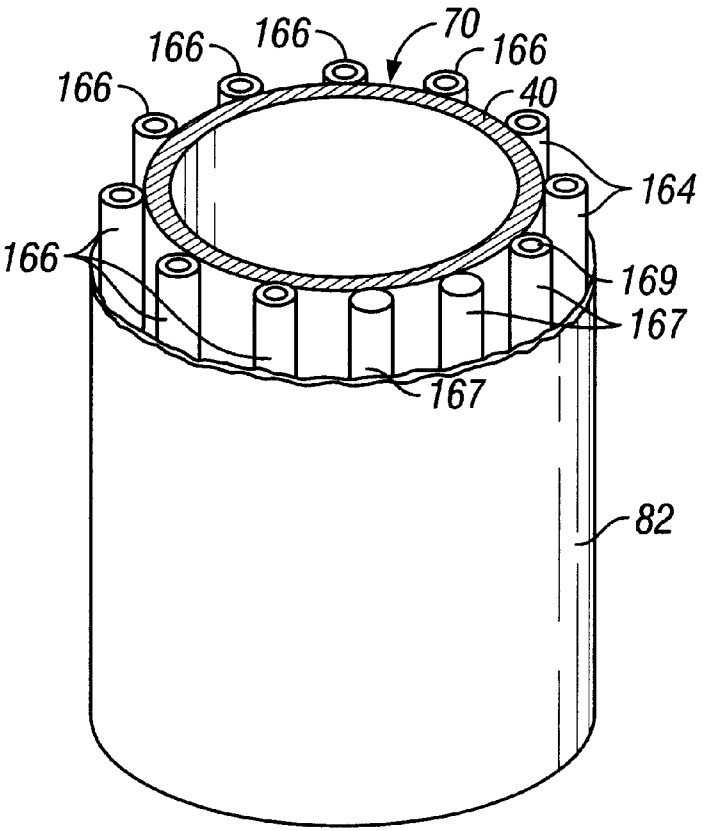

As shown in FIGS. 7 and 8, instead of the encapsulant 33, the lines 164–167 may be protected by other types of layers. For example, for another well casing 70, the pipe 40 is covered by an outer protective sleeve 76 made out of a puncture resistant material (e.g., Kevlar). In another well casing 80, the lines 164–167 are protected by a steel tape 86 wrapped around the lines 164–167.

Figure 9:
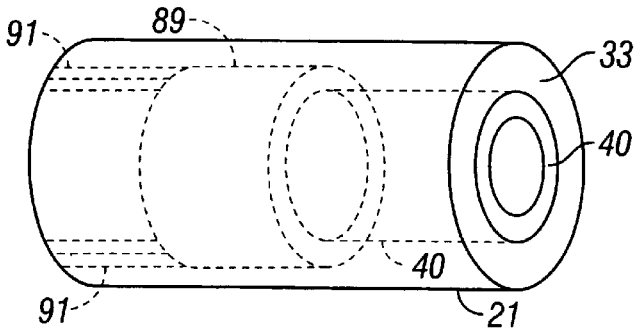
FIG. 9 is a perspective view of a battery embedded in the casing.

Although the electrical lines 164 may receive power (for distribution to downhole tools) from a generator on the surface of the well, the infrastructure may also receive power from power sources located downhole. For example, the communication infrastructure may receive power from one or more annular batteries 89 (FIG. 9) that are embedded in the encapsulant 33 and circumscribe the tubing 40. Electrical power lines 91 (also embedded within the encapsulant 33) extend from the battery 89 to other circuitry (e.g., the electrical lines 164) within the well. The downhole power sources may also be electrical generators embedded within the casing 21. For example, the fluid lines 166 may be used to actuate a rotor so that electricity is generated on an inductively-coupled stator.

By providing a communication infrastructure within the casing 21, the casing 21 may function both as a conduit for well fluid (e.g., as a monobore casing) and as a support network for controlling the flow of the well fluid which may be desirable to control the quality of the fluid produced by the wall. For example, in the subterranean well (FIG. 2), a lateral well bore 20 extends through several production zones 26 (e.g., production zones 26*a–c*) of a producing formation. Each of the production zones 26 is capable of furnishing well fluid (e.g., a mixture of oil, gas, and water), and the composition of the well fluid might vary from one production zone 26 to the next. For example, one production zone 26*a* might produce well fluid having a larger than desirable concentration of water, and another production zone 26*c* might produce well fluid having a desirably high concentration of oil.

The well casing 21 has a central passageway which is used to transport the production fluid away from the producing formation and toward the surface of the well. Because it may be undesirable to receive well fluid from some of the production zones 26, the casing 21 has sets 28 (e.g., sets 28*a–c*) of radial ports to selectively control the intake of well fluid from the production zones 26. The sets 28 of radial ports are operated from power received from the electrical lines 164.

The casing 21 has one set 28 of radial ports for each production zone 26. Thus, to close off a selected production zone 26 from the central passageway of the tubing 12, the set 28 of radial ports associated with the selected production zone 26 is closed. Otherwise, the set 28 of radial ports is open which allows the well fluid to flow from the production zone 26 into the central passageway of the tubing 21.

Each production zone 26 is penetrated by creating passages 23 in the producing formation (created by, e.g., shaped charges). An annular space between the tubing 21 and the earth in the production zone 26 is sealed off by two packers 25 or other sealing elements located at opposite ends the production zone 26, and this annular space is packed with sized gravel to form a gravel bed 25 which serves as a filter through which the well fluid passes. Between the production zones 26, the annular space between the tubing 21 and the earth may be filled with cement to secure the tubing 21 within the lateral well bore 20.

Figure 10:
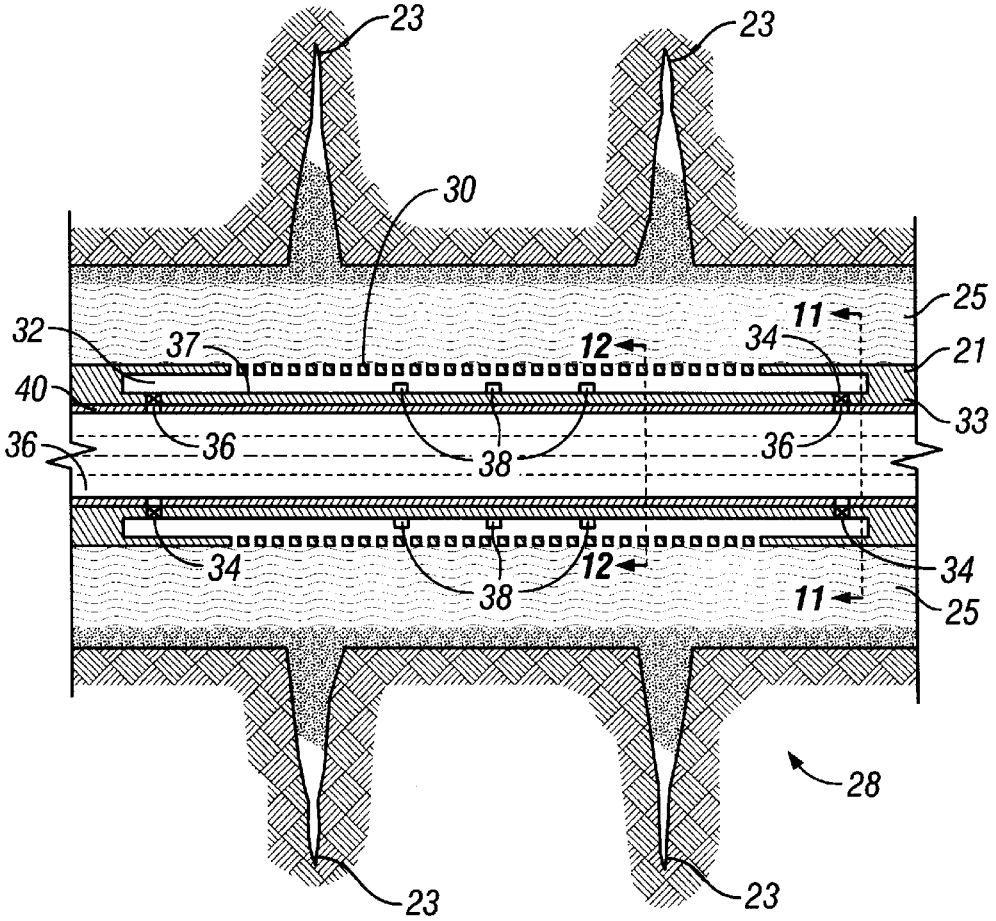
FIG. 10 is a schematic view of a production zone of the well bore of FIG. 2.

As shown in FIG. 10, the inner flow path of the tubing 40 forms the center passageway of the tubing 21 which receives well fluid via perforations, or radial ports 36, formed in the pipe 40. As described below, embedded with the encapsulant 33 are valves which selectively control the flow of the well fluid through the radial ports 36.

For each set 28 of radial ports, the encapsulant 33 is used to form a valve capable of receiving well fluid, detecting the composition of the well fluid that is received, and selectively furnishing the well fluid to the center passageway of the tubing 40 based on the composition detected. A screen 30 formed in the encapsulant 33 circumscribes the central passageway of the tubing 40. The screen 30 receives well fluid from the formation, and the openings of the screen 30 are sized to prohibit the sized gravel in the gravel bed 25 from entering the tubing 40.

To monitor the composition of the well fluid entering the tubing 40 (via the screen 30), an annular space 32 is formed in the interior of the encapsulant 33. The well fluid enters through the screen 30 and flows into the annular space 32 where the composition of the well fluid is monitored by sensors 38. Depending on the composition of the well fluid (as indicated by the sensors 38), solenoid valves 34 are used to control the flow of the well fluid through the radial ports 36 and into the central passageway of the tubing 40.

The sensors 38 monitor such characteristics as water/oil ratio, oil/gas ratio, and well fluid pressure. These measurements are received by a controller 150 (FIG. 6) which determines whether to open or close the valves 34 (and the associated set 28 of radial ports). Alternatively, the measurements from the sensors 38 are monitored at the surface of the well by an operator who controls the valves 34 for each set 28 of radial ports.

Figure 11:
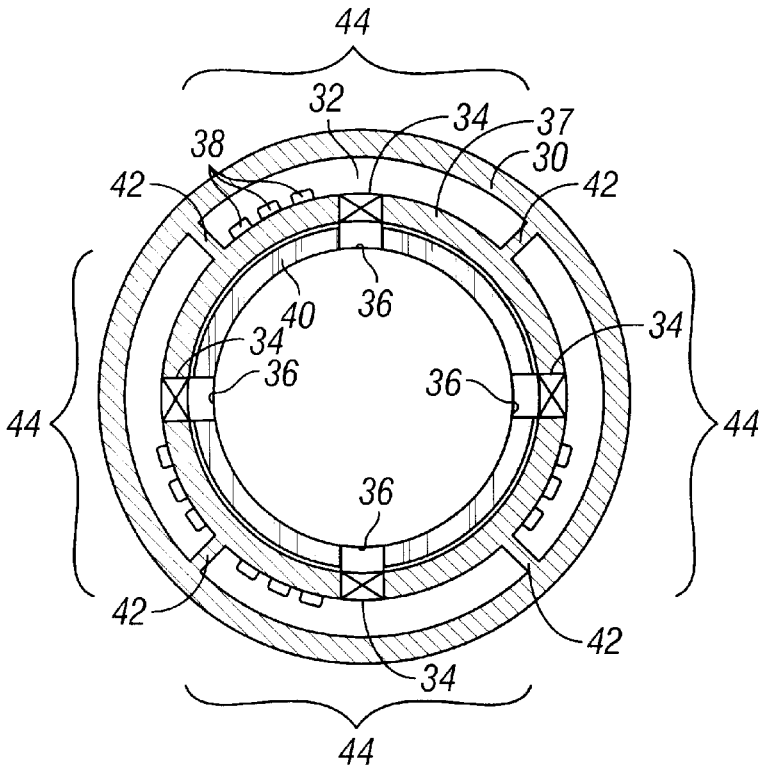
FIG. 11 is a cross-sectional view taken along line 11—11 of FIG. 10.
Figure 12:
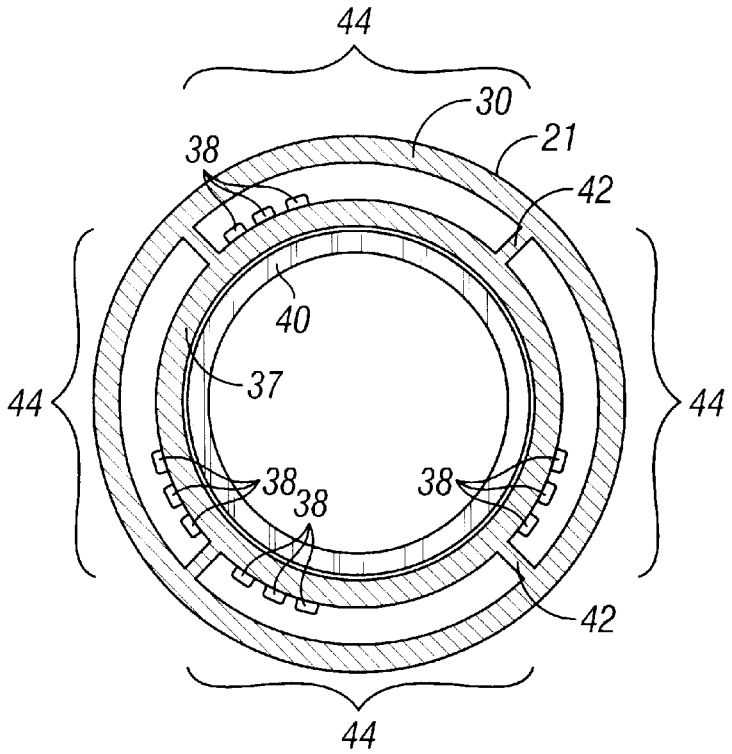
FIG. 12 is a cross-sectional view taken along line 12—12 of FIG. 10.

As shown in FIGS. 11 and 12, each set 28 of radial ports has four cylindrical sections 44. Each section 44 has at least one valve 34 and three sensors 38. The sections 44 are separated by partitions 42 which radially extend from the inner layer 37 to the outer screen 30. Therefore, regardless of the orientation of the tubing 21 in the lateral well bore 20, the set 28 of radial ports control the flow of the well fluid into the central passageway of the tubing 21.

Figure 13:
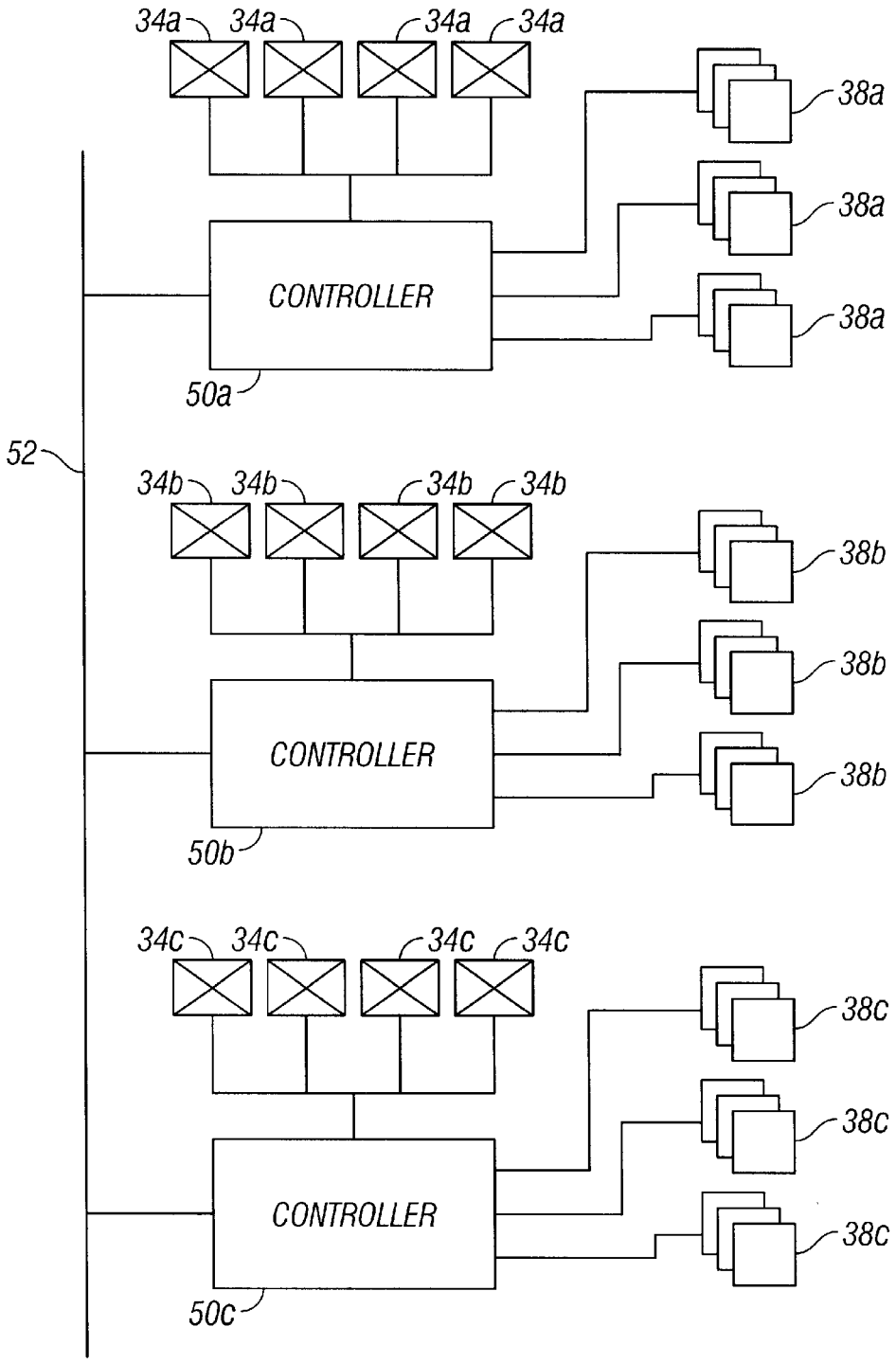
FIG. 13 is an electrical block diagram of circuitry of the production zones.

As shown in FIG. 13, each set 28 of radial ports has the controller 50 (e.g., a microcontroller or nonintelligent electronics) which receives information from the sensors 38 indicative of the composition of the well fluid, and based on this information, the controller 50 closes the valves 34 of the section 44. Due to the orientation of the casing 21, some of the sections 44 may not receive well fluid. To compensate for this occurrence, the controller 50 (via the sensors 38) initially determines which sections 44 are receiving well fluid and closes the other sections 44.

The controllers 50 (e.g., controllers 50*a–c*) of the sets 28 communicate with each other via a electrical line, or serial bus 52. The bus 52 allows the controllers 50 to serially communicate the status of the associated set 28 of radial ports. This might be advantageous, for example, to entirely block out undesirable well fluid from entering the central passageway by closing several sets 28 of radial ports. Thus, if one production zone 26*b* is furnishing well fluid having a high concentration of water, the associated set 28*b* of radial ports is closed. In addition, the adjacent sets 28*a* and 28*c* of radial ports may also be closed. The controller 50 and electrical bus 52 are embedded within the encapsulant 33.

Figure 14:
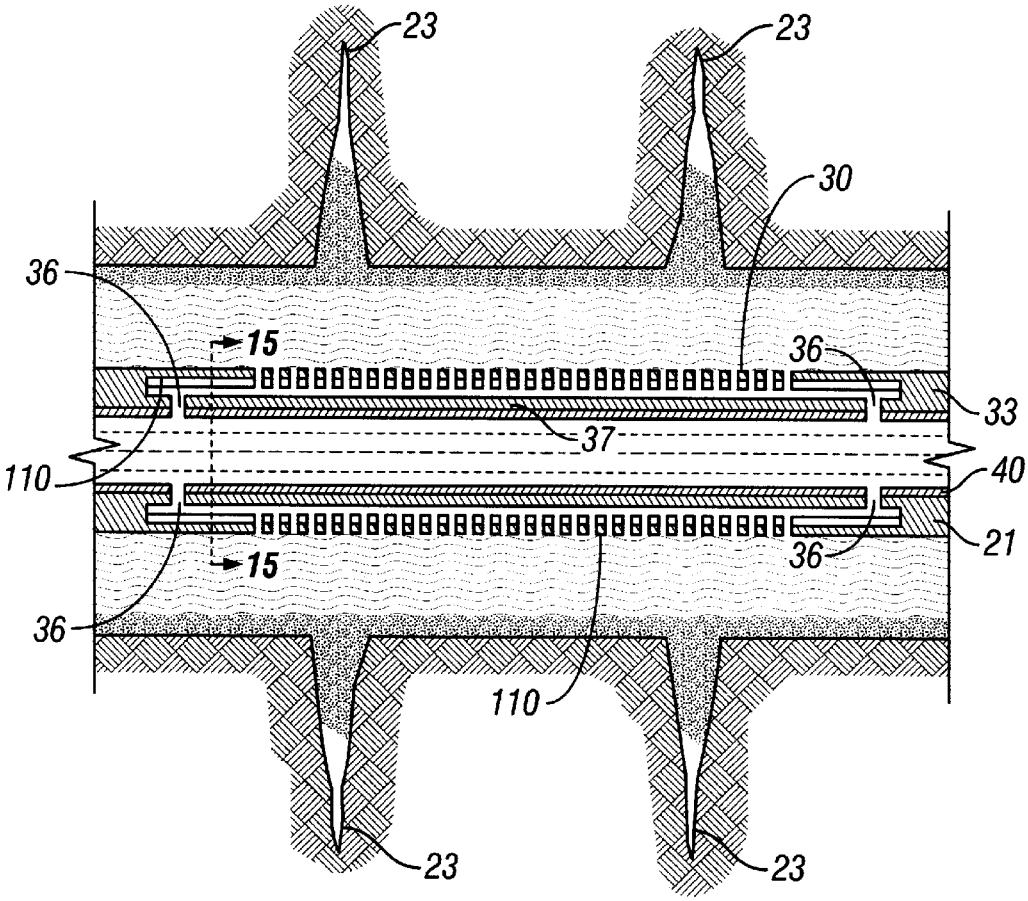
FIGS. 14 and 16 are a schematic views of a production zone for another type of tubing.
Figure 15:
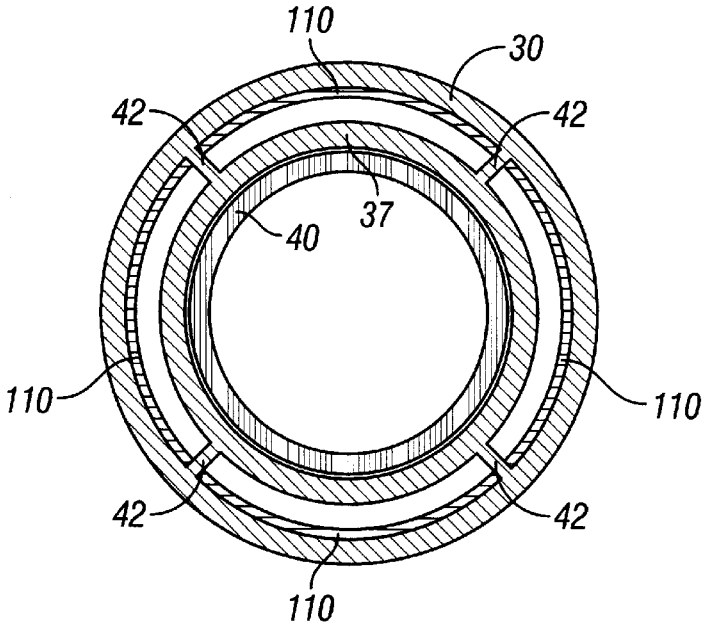
FIG. 15 is a cross-sectional view taken along line 15—15 of FIG. 14.
Figure 16:
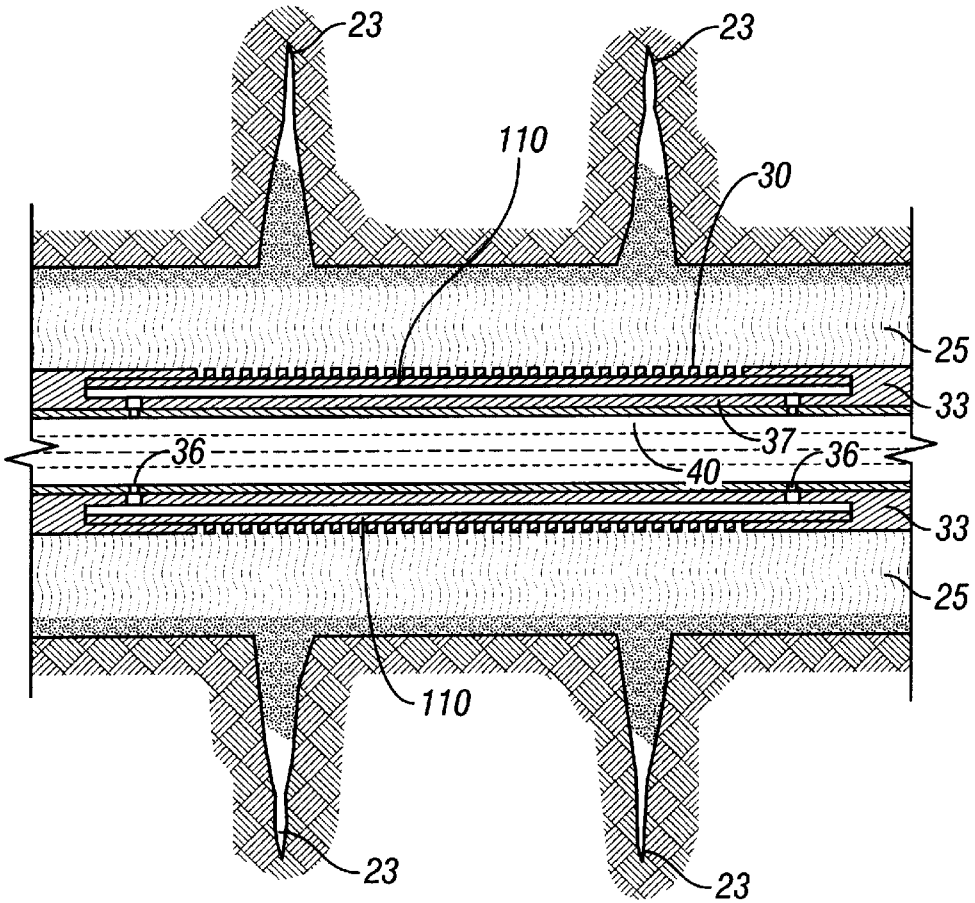

As shown in FIGS. 14 and 15, instead of using valves and electronics to selectively open and close the sets 28 of radial ports, a material responsive to a particular composition of well fluid might be used to selectively block the openings of the screen 30. For example, a layer 110 of a water absorbing material (e.g., clay) swells in the presence of water. The layer 110 is secured to the inside of the screen 30. Openings in the layer 110 align with the openings in the screen 30. Therefore, when the concentration of water in the well fluid is below a predetermined level, the well fluid passes through the layer 110 and into the central passageway of the tubing 40. However, when the concentration of water in the well fluid is above the predetermined level, the layer 110 swells and closes the openings in the layer 110 (FIG. 16) which blocks the openings in the screen 30.

Figure 17:
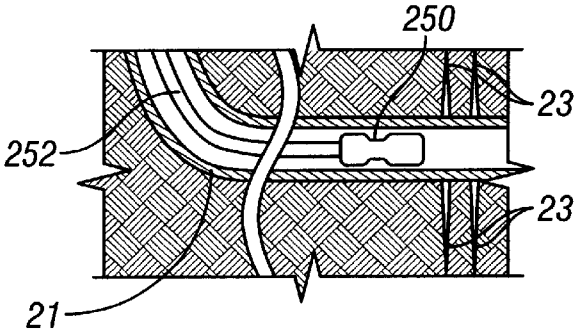
FIGS. 17 and 18 are schematic diagrams illustrating installation of a pump in a lateral well bore according to one embodiment of the invention.
Figure 19:
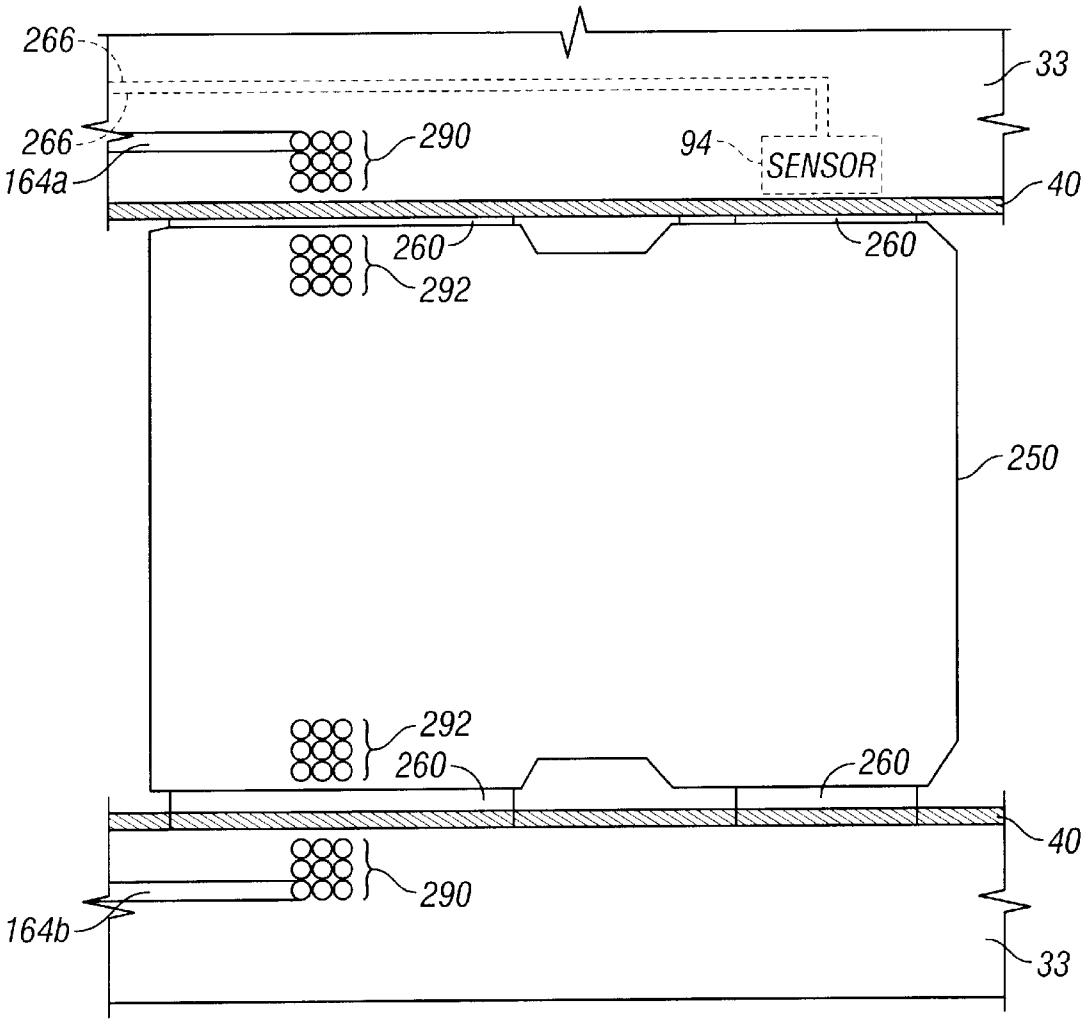
FIG. 19 is a schematic view illustrating the transfer of power between the pump and electrical lines in the casing.

The producing formation frequently does not exert sufficient pressure to propel the well fluid to the surface. As shown in FIG. 17, because the power lines 164 are embedded within the encapsulant 33, the lines 64 may be used to supply power to a downhole tool, such as a pump 250 located within the well bore 20. As shown in FIG. 19, for purposes of transmitting power to the pump 250, a primary coil 290 is embedded within the encapsulant 33. When the pump 250 is installed in the tubing 21, the primary coil 290 transfers power to a secondary coil 292 located within the pump 50. The primary coil 250 receives power via two electrical lines 164*a* and 164*b* embedded within the encapsulant 33. To detect when the pump 250 is in the correct location within the tubing 21, a sensor (embedded within the encapsulant 33 and not in shown in FIG. 17) is used.

To install the pump 250 within the lateral well bore, a coiled tin 252 extending from the surface of the well) is used to push the pump 250 into the vicinity of one of the production zones 26 (see FIG. 2).

Figure 18:
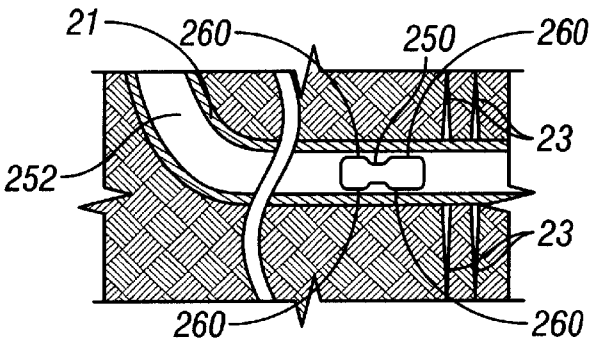

Referring to FIG. 18, Once installed in the well bore 20, the pump 250 is sealed in place via packers 260. As described further below, once power is delivered to the pump 250, the pump 250 pumps the well fluid away from the producing formation and up through the central passageway of the tubing 21 to the surface of the well.

The sensor 194 may be any type of mechanical or electrical sensor used to detect the presence of the pump 250. For example, the sensor 194 may be a Hall effect sensor used to detect the angular rotation of a shaft of the pump 250. When the pump 250 is positioned such that the two coils 290 and 292 are optimally aligned, the angular rotation of the shaft exceeds a predetermined maximum rating. Besides using the sensor 194, a mechanical stop (not shown) may be located inside the pipe 40 to prevent movement of the pump 250 past a predetermined location within the tubing 21.

Figure 20:
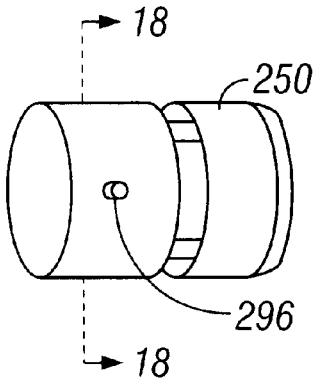
FIG. 20 is a perspective view of the pump.
Figure 21:
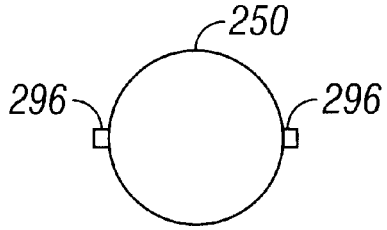
FIG. 21 is a cross-sectional view of the pump taken along line 21—21 of FIG. 20.
Figure 22:
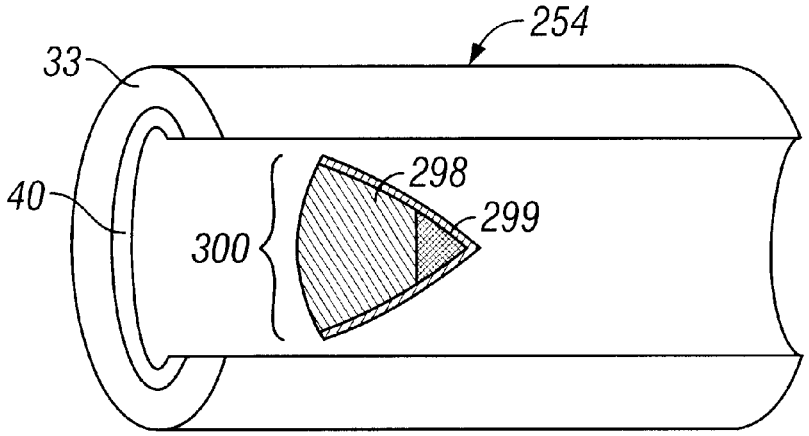
FIG. 22 is a cut-away view of the tubing.

As shown in FIGS. 20–22, instead of inductively connecting the electrical line 164 to the pump 250, the electrical lines 164 may be directly connected to the pump 250. In this embodiment, the pump 250 has two spring-loaded contacts 296 which are adapted to form a connection with one of two connectors on the interior of the pipe 40. Each connector 300 has an insulated depression 298 formed in the interior of the pipe 40. The depression 298 forms a narrow guide which directs the contact 296 to a metallic pad 299 electrically connected to one of the electrical lines 164.

Figure 23:
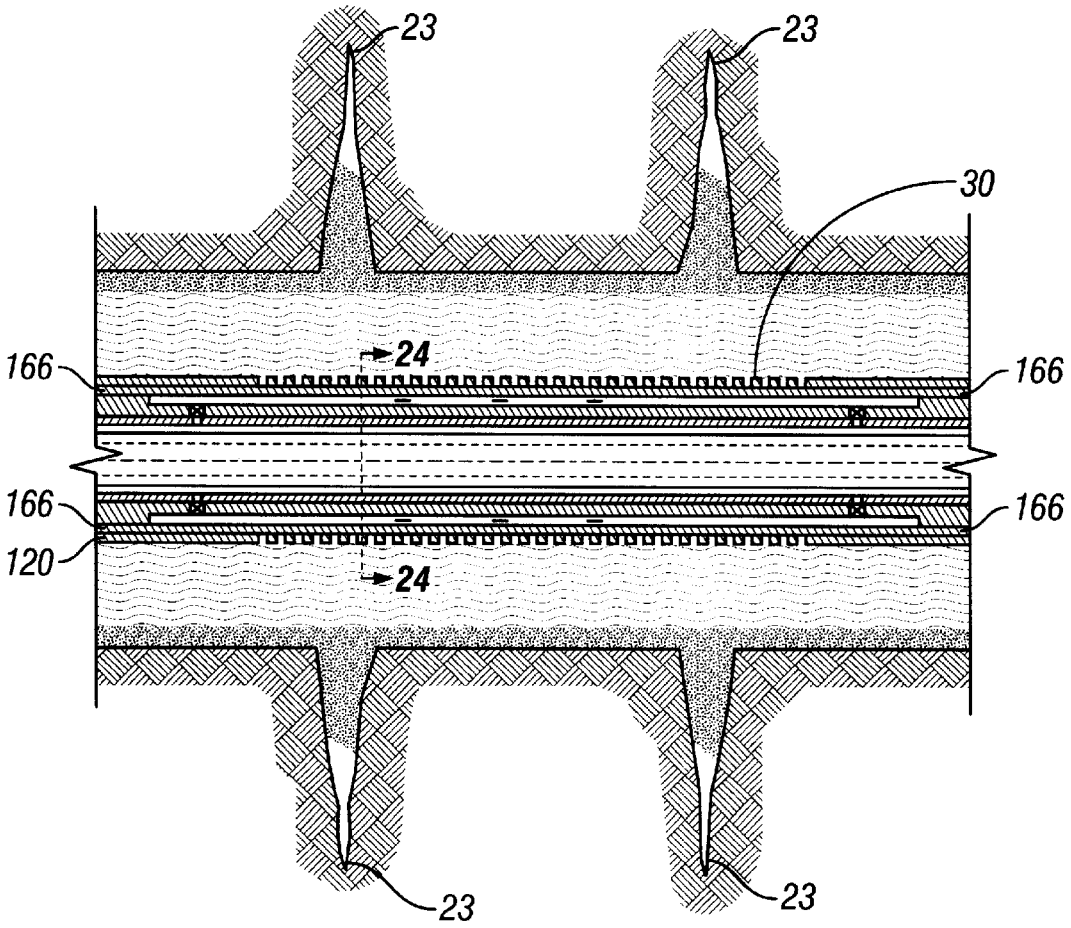
FIG. 23 is a schematic view illustrating a lateral well bore according to one embodiment of the invention.
Figure 24:
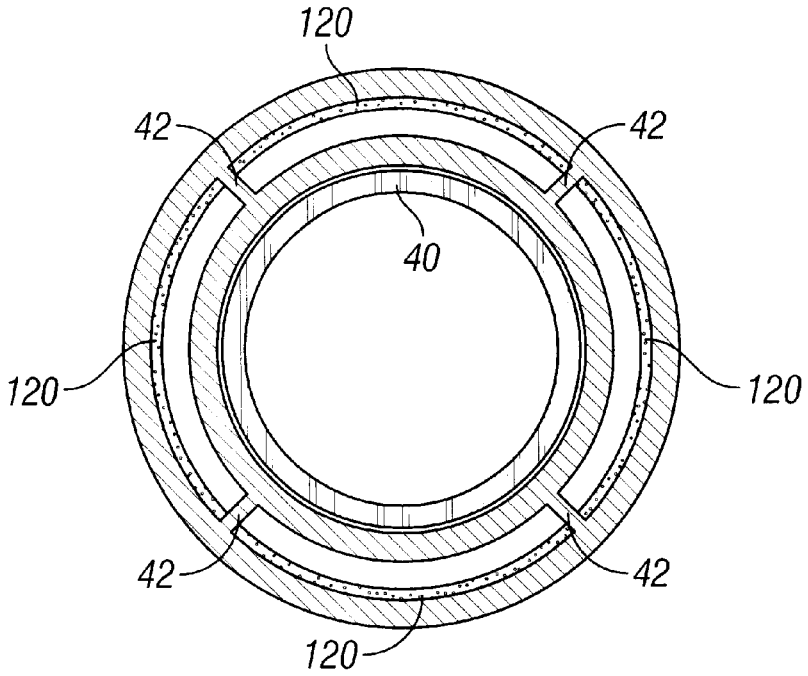
FIG. 24 is a cross-sectional view taken along line 24—24 of FIG. 23.

The fluid lines 166 may also be used to transfer chemicals downhole. For example, anti-scaling chemicals might be used to prevent scales from forming on the screen 30. As shown in FIGS. 23 and 24, the chemicals are transported downhole using some of the fluid lines 166, and a dispersion material 120 (e.g., a sponge) is in fluid communication with the lines 166. The chemicals flow into dispersion material 120 and are uniformly distributed to the region immediately surrounding the screen 30. Additional fluid lines 166 may be used to transfer excess chemicals to dispersion material 120 of another set 28 of radial ports.

Figure 25:
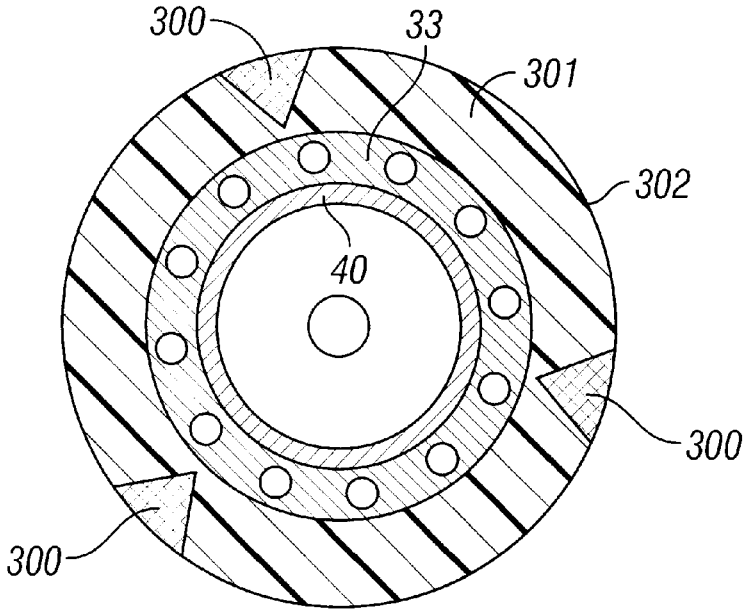
FIG. 25 is a cross-sectional view of another well casing.

The casing 21 may be laminated by multiple layers. For example, as shown in FIG. 25, another layer of encapsulant 301 circumscribes and is secured to the encapsulant 33. The encapsulant 301 has embedded shaped charges 300 which might be actuated, for example, by one of the electrical lines 166.

Other embodiments are within the scope of the following claims.

What is claimed is:

1. A tubing for use in a well bore capable of furnishing a well fluid, the tubing comprising:

a central section forming a central passageway of the tubing;

a chamber partially but not completely circumscribing the central section;

a port to establish well fluid communication between the well bore and the chamber; and a mechanism to detect a composition of the well fluid and control well fluid communication between the chamber and the central passageway based on the composition.

2. The tubing of claim 1, wherein the mechanism comprises:

a valve positioned to control the communication of the well fluid between the central passageway and the annular chamber;

a sensor for detecting the composition; and a controller responsive to the sensor and connected to operate the valve.

3. The tubing of claim 1, wherein the chamber has at least one opening for communicating the well fluid to the central passageway; and the mechanism controls the flow of well fluid through said at least one opening.

4. The tubing of claim 1, further comprising:

another chamber partially circumscribing a region of the central section not circumscribed by the first chamber.

5. The tubing of claim 1, wherein the mechanism comprises a material response to a predetermined composition, and wherein the material is positioned to alter the well fluid communication based on the presence of the predetermined composition.

6. A method for use in a well bore capable of furnishing a well fluid, the method comprising:

determining a composition of the well fluid; and automatically, selectively controlling well fluid communication between a chamber of a tubing and a central passageway of a central section of the tubing, the chamber partially but not completely circumscribing the central section of the tubing.

7. The method of claim 6, wherein the determining includes using a sensor, and wherein the controlling includes using a valve to control the well fluid communication between the chamber and the central passageway.

8. The method of claim 6, wherein the determining includes:

receiving the well fluid in the chamber.

9. The method of claim 6, further comprising:

automatically, selectively controlling well fluid communication between another annular chamber of the tubing and the central passageway of the central section of the tubing, said another chamber partially circumscribing the central section a region of the central section not circumscribed by the first chamber.

10. The method of claim 6, wherein the determining includes using a material responsive to a predetermined composition, and wherein the controlling includes using the material to alter the well fluid communication based on the presence of the predetermined composition.

* * * * *